United States Patent [19]

Satonaka et al.

[11] Patent Number: 4,708,470

[45] Date of Patent: Nov. 24, 1987

[54] OPERATION PANEL AND A DISPLAYING METHOD FOR A COPYING MACHINE

[75] Inventors: Shinobu Satonaka, Toyonaka; Masanobu Takahashi, Suita; Takahiro Wakikaido, Yao; Masahiro Yoshioka, Matsubara, all of Japan

[73] Assignee: Mita Industrial Co., Ltd., Japan

[21] Appl. No.: 779,558

[22] Filed: Sep. 24, 1985

[51] Int. Cl.[4] ..... G03G 15/00

[52] U.S. Cl. ..... 355/77; 355/14 R

[58] Field of Search ..... 355/14 R, 14 C, 77, 355/3 R

[56] References Cited

U.S. PATENT DOCUMENTS

| | | | |
|---|---|---|---|
| 4,067,649 | 1/1978 | Hubbard et al. | 355/14 R |
| 4,312,587 | 1/1982 | Ariga et al. | 355/8 |
| 4,315,685 | 2/1982 | Inuzuka et al. | 355/14 R |
| 4,332,464 | 6/1982 | Bartulis et al. | 355/14 C |
| 4,392,741 | 7/1983 | Inuzuka et al. | 355/14 R |
| 4,394,087 | 7/1983 | Irie et al. | 355/14 E |
| 4,398,819 | 8/1983 | Schron | 355/14 R |
| 4,441,804 | 4/1984 | Shibazaki et al. | 355/14 R |
| 4,477,178 | 10/1984 | Furuichi et al. | 355/14 R |
| 4,496,237 | 1/1985 | Schron | 355/14 C |
| 4,511,241 | 4/1985 | Tsudaka | 355/14 R |
| 4,542,985 | 9/1985 | Honma et al. | 355/69 |

FOREIGN PATENT DOCUMENTS

| | | |
|---|---|---|
| 57-172354 | 1/1983 | Japan . |
| 58-31347 | 2/1983 | Japan . |
| 2077190 | 12/1981 | United Kingdom . |
| 2087577 | 5/1982 | United Kingdom . |
| 2111696 | 7/1983 | United Kingdom . |

OTHER PUBLICATIONS

Xerox Disclosure Journal, vol. 9, No. 4, Jul./Aug. 1984, p. 269; Stamford, US-J. D. Richar: "Direct-Select Vacuum Fluorescent for Copier Application".

*Primary Examiner*—R. L. Moses

*Attorney, Agent, or Firm*—Beveridge, De Grandi & Weilacher

[57] ABSTRACT

An operation panel is provided in a copying machine wherein a print key is mounted on the right end part, various data displays are mounted on the center part, a set magnification display is formed at one end of these various data displays in the longitudinal direction thereof, and a set density display is formed at the other end thereof. A magnification setting key is mounted close to the set magnification display, and a density setting key is mounted close to the set density display. An original size display symbol is formed close to one side edge of the displays in the lateral direction, and a copy paper size display symbol is formed close to the other end thereof. Various function selecting keys are mounted somewhat apart from the various data displays. Before starting copying operation, display of the data that is to be set and entered by the operator is cleared. Display of set data is cleared during setting of the copy image density by automatic exposure. After completing density setting operation, the set data is displayed.

7 Claims, 7 Drawing Figures

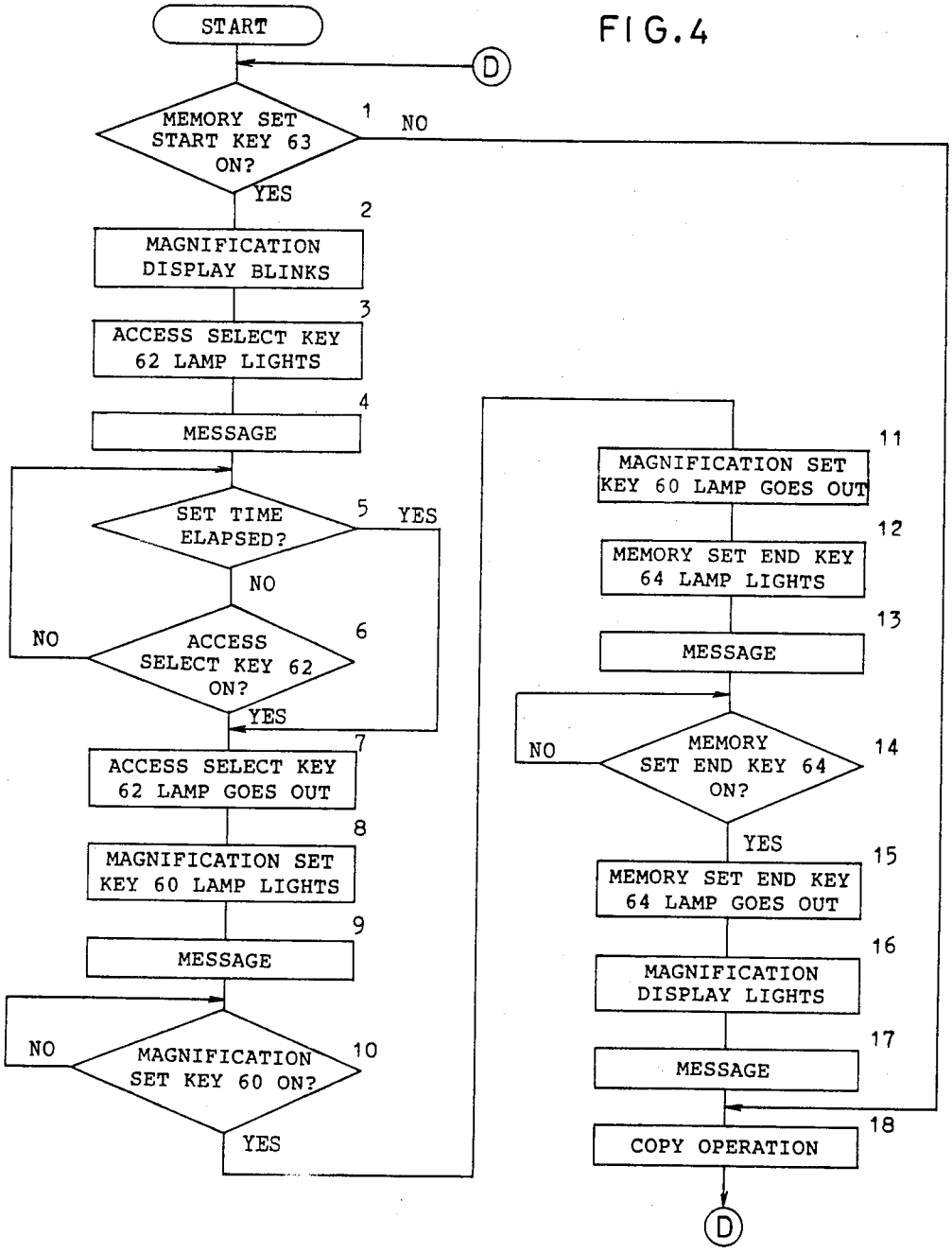
FIG.4
START
D
MEMORY SET START KEY 63 ON?
1
NO
YES
2
MAGNIFICATION DISPLAY BLINKS
3
ACCESS SELECT KEY 62 LAMP LIGHTS
4
MESSAGE
SET TIME ELAPSED?
5
YES
NO
NO
ACCESS SELECT KEY 62 ON?
6
YES
7
ACCESS SELECT KEY 62 LAMP GOES OUT
8
MAGNIFICATION SET KEY 60 LAMP LIGHTS
9
MESSAGE
NO
MAGNIFICATION SET KEY 60 ON?
10
YES
11
MAGNIFICATION SET KEY 60 LAMP GOES OUT
12
MEMORY SET END KEY 64 LAMP LIGHTS
13
MESSAGE
NO
MEMORY SET END KEY 64 ON?
14
YES
15
MEMORY SET END KEY 64 LAMP GOES OUT
16
MAGNIFICATION DISPLAY LIGHTS
17
MESSAGE
18
COPY OPERATION
D

OPERATION PANEL AND A DISPLAYING METHOD FOR A COPYING MACHINE

BACKGROUND OF THE INVENTION

The present invention relates to an operation panel and a displaying method for a copying machine, and more specifically, to an operation panel which facilitates recognition of various operating keys on the operation panel and displays for displaying various data and to a displaying method which enables adequate recognition of data to be set and entered by the operator or which enables display of the automatic exposure operation state without increasing the type of displays.

Conventionally, in copying machines, for the purpose of improving convenience of use, machines providing a magnification change function, an automatic magnification setting function, and an automatic copy paper selecting function and the like have been developed. Corresponding to these functions, displays for displaying various functions are provided and also operation parts for carrying out various functions are provided. As a result the arrangement of the various keys and the various displays is complicated, and also the operating procedure is complicated.

Accordingly, an adequate copying operation can be made only after original size, copy paper size, magnification, copy quantity and the like are set before performing copying operation. Nevertheless, some setting operation is sometimes forgotten, and in this case improper operation takes place, such as excessively large or small copy image or an excessively large or small quantity of copies. Particularly, when selecting the automatic magnification setting function or the automatic copy paper selecting function, it can take the operator a long time to locate the operating key for selecting the function, or the operator sometimes cannot identify the key for selecting the desired function and so operates an incorrect key.

Also, when selecting the automatic magnification setting function or the automatic copy paper selecting function, the above-mentioned setting operations are not required to be made wholly, and discernment between the setting operations to be made and those that are automatic, and so not required to be made, has to be performed, and thereby the above-mentioned trouble takes place even more so.

Furthermore, for the copying machine provided with an automatic exposure function, it is desirable that the mounting of a display device solely for display purpose on the already complicated display panel be avoided if possible and that an indication of whether the automatic exposure function is selected or not selected be adequately visible. Because, in the case where the automatic exposure function is selected, the wrong impression is sometimes given that the original copying operation already has been completed during the exposure setting operation prior to the copying operation, and as a result the original cover is opened when the automatic exposure setting operation is completed, and a worse quality copy is obtained than would be produced by the original copying operation.

SUMMARY OF THE INVENTION

An object of the present invention is to facilitate recognition of various displays on an operation panel of a multi-functional copying machine.

Another object of the present invention is to prevent a malfunction in a copying machine before the malfunction occurs.

Still another object of the present invention is to make the operator adequately recognize data to be set and entered on the operation panel of a copier in order to make copies as desired.

Still another object of the present invention is to facilitate various setting operations on the operation panel of a multi-functional copying machine.

Still another object of the present invention is to prevent an original cover from being opened in the middle of operation of the automatic exposure function in a copying machine provided with the automatic exposure function.

Still another object of the present invention is to display the state wherein the automatic exposure function is carried out without complicating display of the operation panel.

On an operation panel in accordance with the present invention, a print key is mounted on the right end of the operation panel of a copying machine, and displays for various set data are mounted collectively on the center part of the copying machine, a set magnification display indicator is provided at one end of the displays in the right-left direction thereof, and a set density display indicator is provided at the other end thereof respectively. A magnification setting key is mounted close to the set magnification display indicator and a density setting key is mounted close to the set density display indicator respectively. An original size display symbol is formed close to one side edge of the displays in the up-down direction thereof, and a copy paper size display symbol is formed close to the other side edge thereof respectively. Further, various function selecting keys are mounted collectively somewhat apart from the displays. These function selecting keys may include an automatic magnification set state selecting key, an automatic copy paper size set state selecting key and an automatic copy image density set state selecting key. Respective manual operating keys which set and enter the above-mentioned data by manual operation may be colored the same as the above-mentioned respective keys, and the keys in a corresponding relation may be mounted close to each other.

Also, a displaying method in accordance with the present invention clears display on the operation panel of data to be set and entered by the operator before starting a copying operation.

Clearing of data display in this case may be made only by operating a specific key, may be made by operating a non-specific key or may be made automatically every time a copying operation is completed. Also, data to be cleared may be all of data which can be displayed, or may be only the data that is to be for selected functions, for example, the automatic magnification setting function, the automatic copy paper selecting function or the like. Specifically, it may be the original size display data, the copy paper size display data, the magnification display data and the copy quantity display data.

Also, the displaying method in accordance with the present invention clears the set data at least upon setting of the copy image density by automatic exposure, and the set data is displayed after the operation of setting the copy image density is completed.

Data to be cleared in this case may be all of data which can be displayed, or may be only the copy image density data which is set by carrying out automatic exposure operation. Also, the period during which display of set data is cleared is preferably a period during which operation of setting the copy image density by means of automatic exposure is completed after the automatic exposure function is selected. Furthermore, data setting by means of key operation may be inhibited during the period when display of the above-mentioned set data is cleared.

BRIEF DESCRIPTION OF THE DRAWINGS

FIG. 3 through FIG. 5 are flow charts.

DESCRIPTION OF THE PREFERRED EMBODIMENTS

Figure 6:
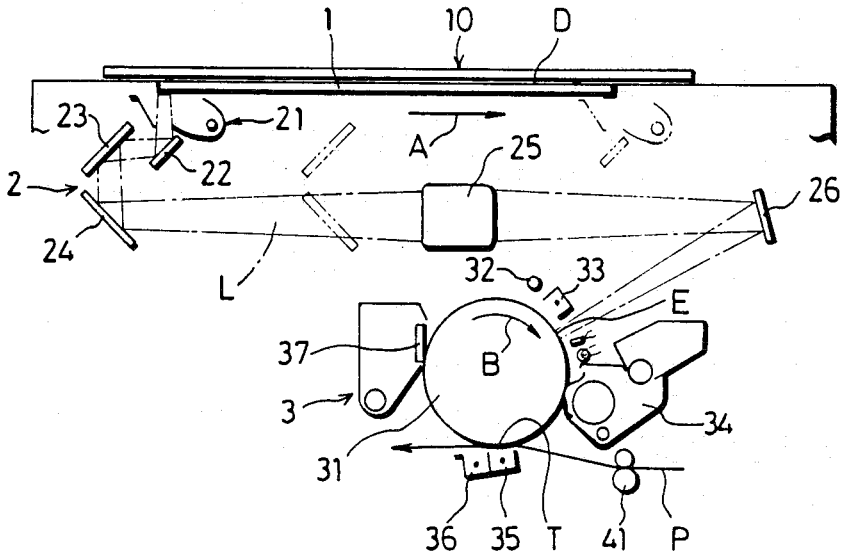
FIG. 6 is a schematic diagram showing an internal mechanism of a copying machine.

FIG. 6 is a major part schematic diagram clearly showing an internal mechanism of an copying machine which is of a type wherein an optical system moves and employs a photoreceptor drum as a photoreceptor.

An original placing table 1 is located on the top surface of a copying machine main body (not illustrated). At a predetermined position under table 1, an optical part 2 is provided an exposure lamp 21, reflecting mirrors 22, 23 and 24, a lens 25 and a reflecting mirror 26. An original D can be scanned, to be exposed in sequence, by moving the exposure lamp 21 and the reflecting mirrors 22, 23 24 in the direction as shown by an arrow A. Then, the above-mentioned light source 21 and the reflecting mirror 22 move in a unitary manner, and the reflecting mirrors 23 and 24 are move in a unitary manner, and setting is made so that the moving speed of the former is double the moving speed of the latter. Then, under the optical part 2, a copy processing part 3 is provided, including a photoreceptor drum 31 rotating in the direction as shown by an arrow B every copying operation, a de-electrifying lamp 32, an electrifying charger 33, a developing apparatus 34, a transfer charger 35, a separation charger 36 and a cleaner 37. An electrostatic latent image is formed by irradiating the light reflected from the original D onto the surface of the photoreceptor drum 31 which is electrified uniformly by the electrifying charger 33, and this electrostatic latent image is made into a toner image by the developing apparatus 34. The toner image can be transferred on a copy paper P. A resist roller 41, constituting a part of a copy paper feeding part, can feed the copy paper P at a speed nearly equal to the peripheral speed of the photoreceptor drum 31. An original cover 10 is mounted so as to be pivotable up and down by means of a hinge mechanism (not illustrated), or the like, to cover the top surface of the original placing table 1.

Figure 1:
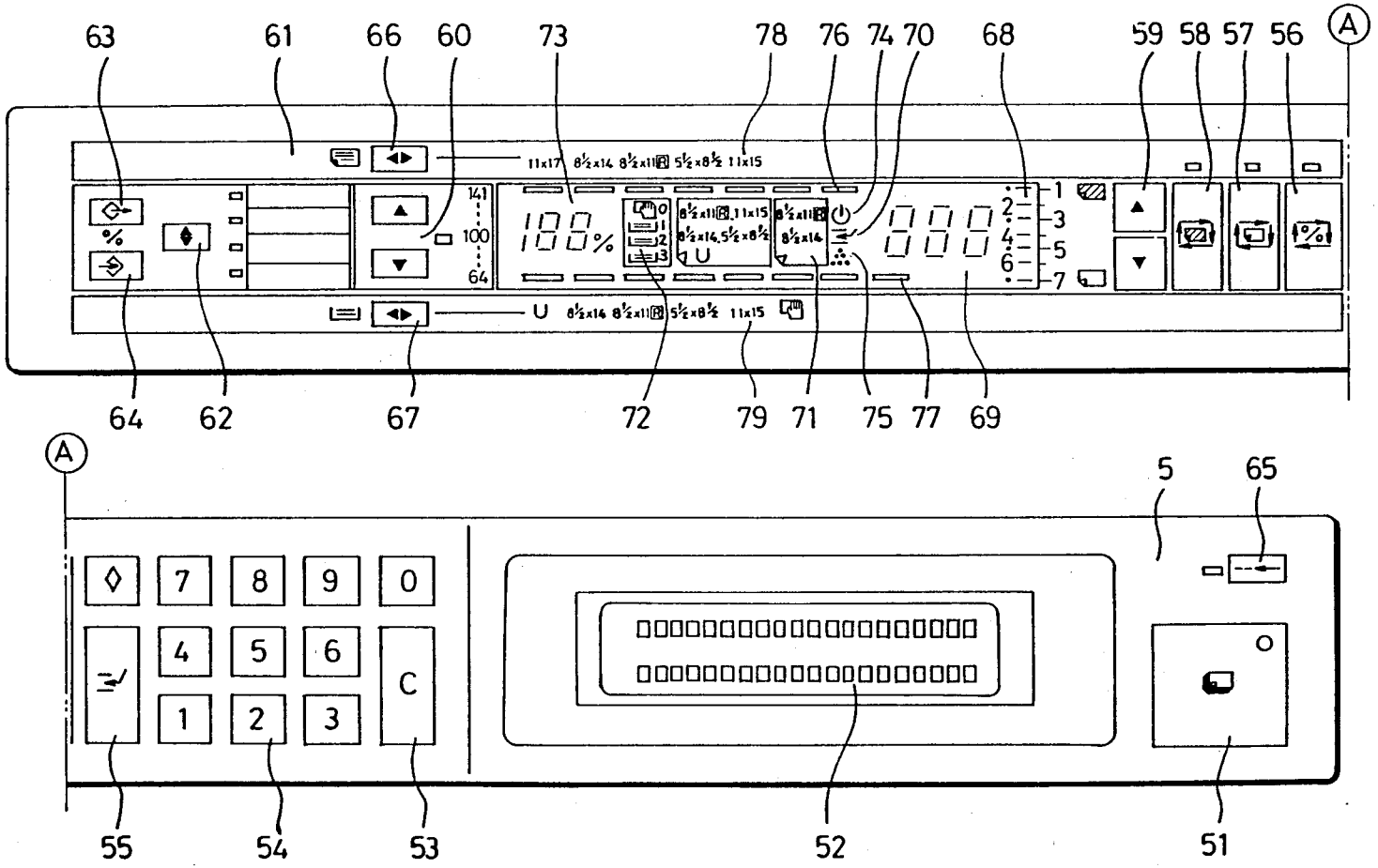
FIG. 1 is a plan view showing an operation panel of a copying machine.

FIG. 1 is a plan view of an operation panel 5 which is mounted on the front-side top surface of the copying machine main body and which includes a print key 51, a display 52 constituted with liquid crystal, LED, EL or the like for displaying operation procedure and the like, a clear key 53, ten numeral keys 54, an interrupt key 55, an automatic magnification setting key 56, an automatic copy paper selecting key 57, an automatic copy image density setting key 58, a density setting key 59, a magnification setting key 60, a set magnification memory control 61, an access selecting key 62, a memory setting start key 63 which starts setting of the magnification to be stored in the set magnification memory 61, and a memory setting end key 64 which ends the setting of magnification. These keys are mounted in sequence from the right side, and also a display clear key 65 is mounted close to the print key 51. Further an original size setting key 66 and a copy paper size setting key 67 are mounted close to the top and bottom sides of the magnification setting key 60.

Between density setting key 59 and mangnification setting key 60, a display part is provided for displaying various set data and the like. This display part includes a set density display 68, a copy quantity display 69, an interrupt display 70, a size display 71, a copy paper feed stage display 72, and a magnification display 73 in sequence from the right side. Also a warm-up display 74 and a toner run-out display 75 are provided close to the interrupt display 70, and further an original size display 76 and a copy paper size display 77 are provided at the top edge and the bottom edge of the display part, respectively. Then, the above-mentioned size display 71 displays the contour line of the selected copy paper as laterally longer or longitudinally longer size and also displays symbols showing the size much as $5\frac{1}{2}\times8\frac{1}{2}$, $11\times15$, or the like, inside each contour line. Also, a symbol 78 showing a regular original size corresponding to each display is provided above the original size display 76 and at the right of the original size setting key 66. A symbol 79, showing a regular copy paper size, a manually inserted copy paper and an universal cassette corresponding to each display, is provided under the copy paper size display 77 and at the right of the copy paper size setting key 67. These size displaying symbols 78 and 79 are parallel with each other, also being parallel with each size displaying symbol whereto respective size displays 76 and 77 correspond, and therefore when the original size display 76 is light-controlled by operating the original size setting key 67 in the state wherein the magnification is set in advance, the copy paper size display 77 is also light-controlled, and also movement of the position of lighting of both of the size displays 76 and 77 is performed in a parallel fashion, and therefore both of the size displays 76 and 77 are watched easily. Then, the automatic magnification setting key 56 and the magnification setting key 60 are colored the same, the automatic copy paper selecting key 57 and the copy paper size display symbol 79 are colored the same, and further the automatic copy image density setting key 58 and the density setting key 59 are colored the same, and the above-mentioned respective colors are selected so as to be different colors which can be easily identified, and thereby a relation of correspondence between each automatic setting key and each manual setting key can be grasped easily. Particularly, by mounting the keys and the like which are in the above-mentioned relation of correspondence close to each other, the relation of correspondence can be grasped more easily.

Also, the above-mentioned set magnification memory 61 is such that set magnification is written by a pencil or the like, but the set magnification may be displayed using liquid crystal or the like.

Figure 2:
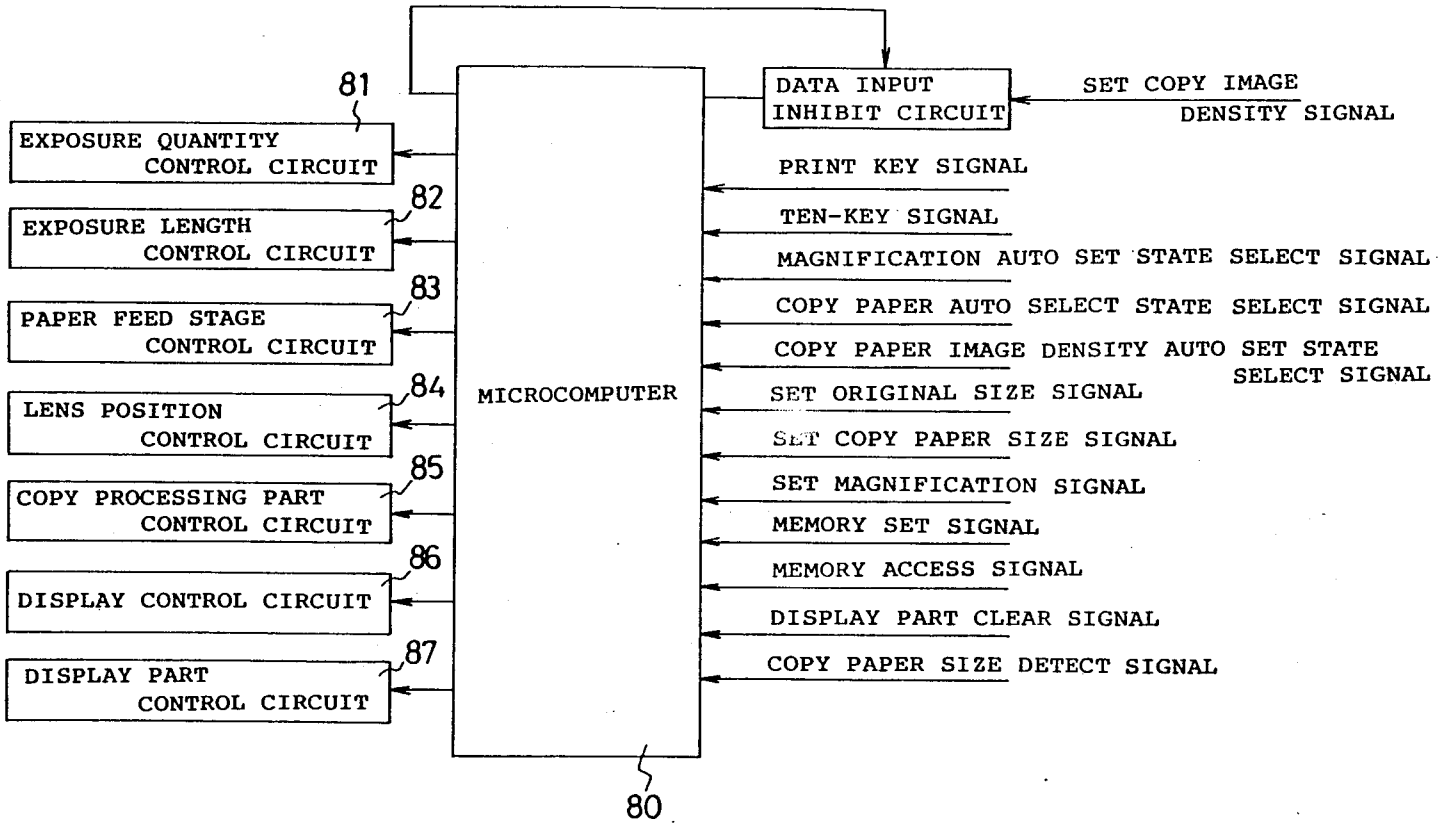
FIG. 2 is a block diagram.

FIG. 2 is a block diagram showing a major part of a copying machine, wherein a print key signal, a ten numeral key signal, an automatic magnification set state select signal, an automatic copy paper select state select signal, an automatic copy image density set state select signal, a set original size signal, a set copy paper size signal, a set magnification signal, a memory set signal, a memory access signal, a display part clear signal, a copy paper size detect signal and the like are applied to a microcomputer 80 having a CPU, a RAM, a ROM, an I/O port, a clock generator and the like. Output signals from the computer 80 are applied to an exposure quantity control circuit 81, an exposure length control circuit 82, a copy paper feed stage control circuit 83, a lens position control circuit 84, a copy processing part control circuit 85, a display control circuit 86, a display part control circuit 87 and the like. Then, the set copy image density signal is applied to the microcomputer 80 through a data input inhibit circuit 88 which is driven by the output signal from the microcomputer 80.

Figures 1, 3:
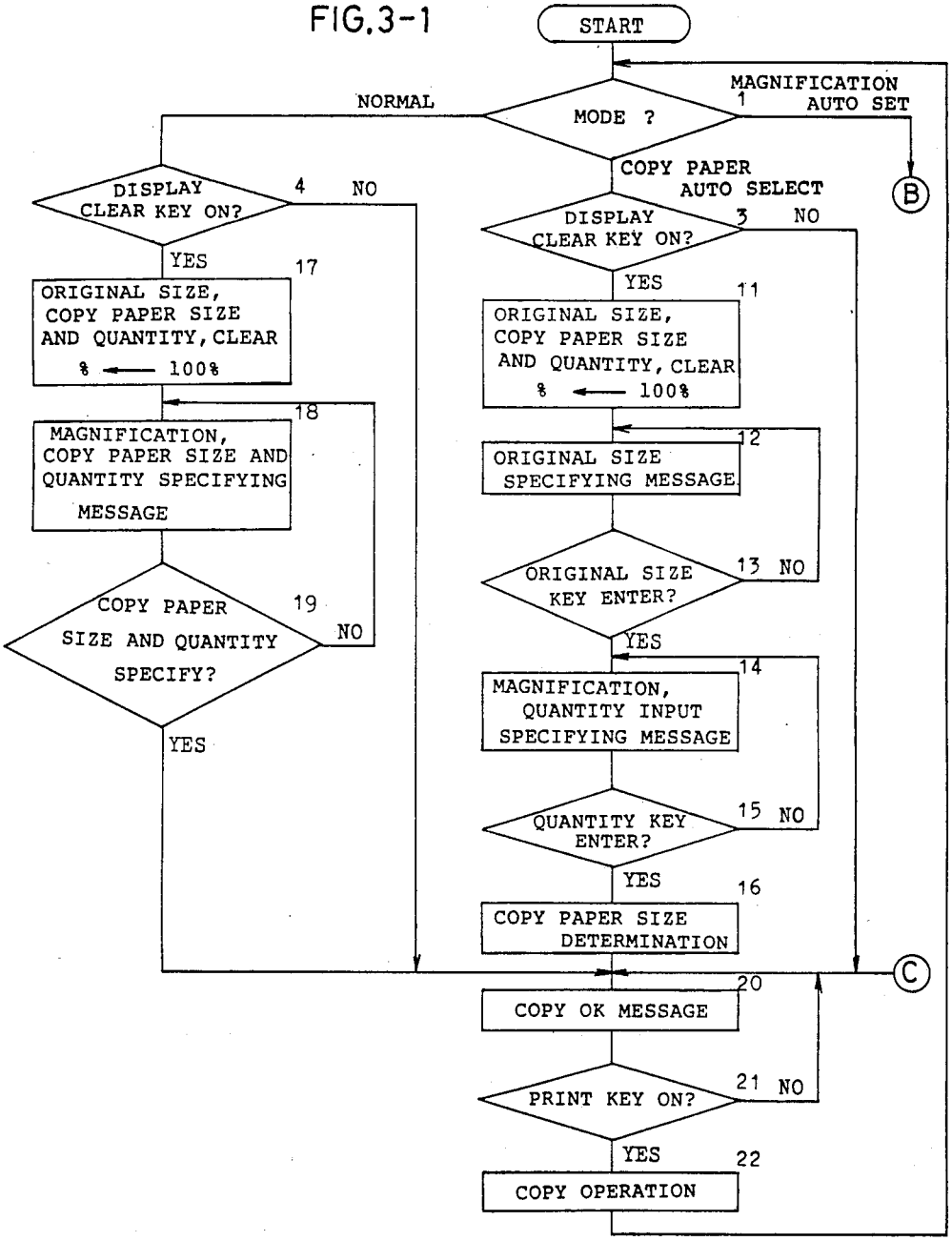
Figures 2, 3:
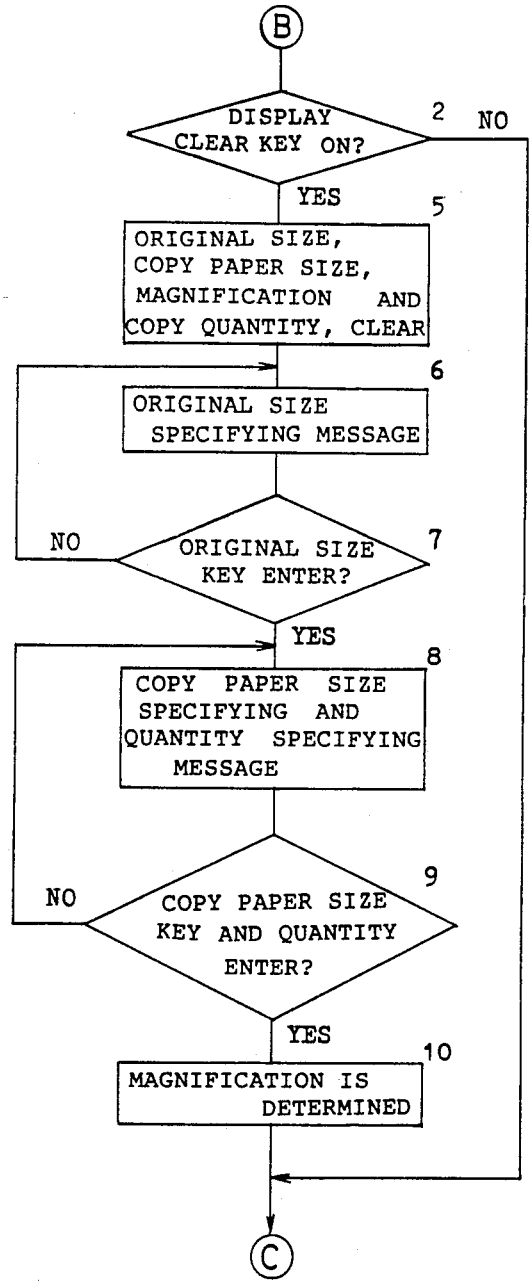
Figure 5:
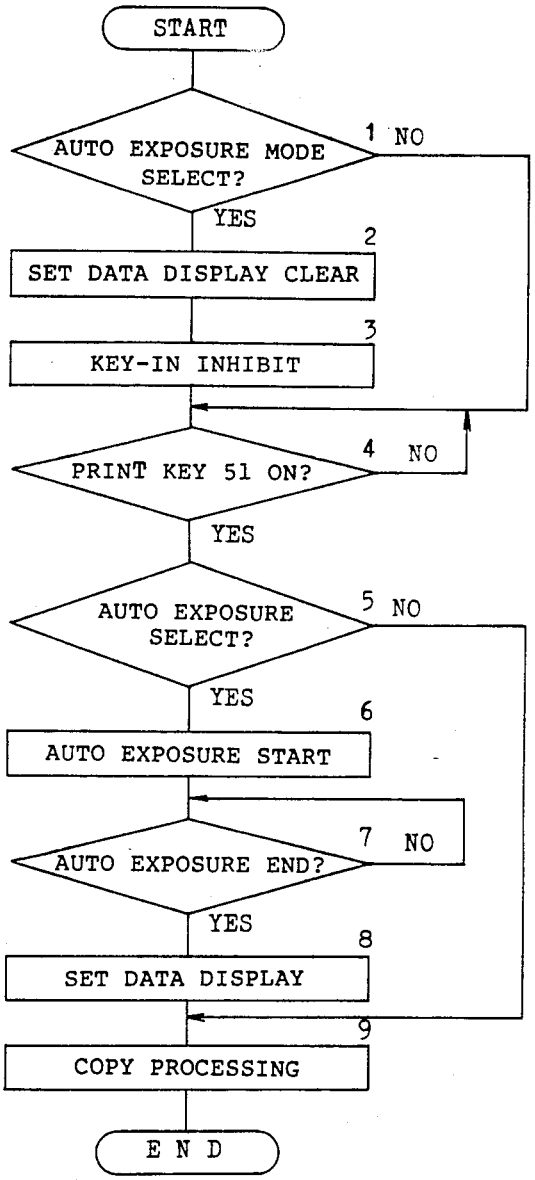

FIG. 3 through FIG. 5 are flow charts showing operation of the copying machine of the above configuration, FIG. 3 shows copying operation corresponding to the select mode, FIG. 4 shows magnification memory operation and FIG. 5 shows copying operation corresponding to whether or not the automatic exposure mode is selected.

First, description is made on FIG. 3.

In step 1, decision is made on whether or not the automatic magnification setting mode or the automatic copy paper size setting mode has been selected. Then, in either case, in any one of steps 2, 3 and 4, decision is made on whether or not the display clear key 65 is turned to ON, and if the display clear key 65 is turned to OFF, in step 20, it is displayed on the display 52 by dot-matrix that copying operation can be made, and processing is in waiting state until the print key 51 is turned to ON in step 21, and a series of copying operations are performed in step 22. Thereater the decisions and processings in step 1 and thereafter are performed again.

On the other hand, (I) When the automatic magnification setting mode is selected and the display clear key 65 FIG. 3-2 is turned ON, the original size display 76, the copy paper size display 77, the magnification display 73, the copy quantity display 69 and the size display 71 are cleared in step 5, and that the setting operation of the original size is to be performed is displayed on the display 52 by a dot-matrix in step 6 character display. Processing is then in waiting state until the setting operation of the original size is performed in step 7. Thereafter, in step 8, the message is displayed on the display 52 in dot-matrix characters that setting the copy paper size and setting the copy quantity are to be performed, and processing is in waiting state until the setting of the copy paper size and the setting of copy quantity are performed in step 9. In step 10, the magnification is calculated based on the set original size and copy paper size, and the lens 25 is moved by means of the lens position control circuit 84 corresponding to the calculated magnification. Subsequently the above-mentioned decisions and processings in step 20 and thereafter are carried out.

(II) When the automatic copy paper size setting mode is selected and also the display key 65 is decided to be turned to ON, the original size display 76, the copy paper size display 77, the copy quantity display 69 and the size display 71 are cleared by means of the display part control circuit 87, and the magnification display 73 is set to 100% in step 11. In step 12, a message is then displayed on the display 52 in dot-matrix characters that operation of setting the original size is to be performed. Processing is in a waiting state until the original size is set in step 13. Thereafter, in step 14 a message is displayed on the display 52 in dot-matrix form that the operation of setting the magnification and the operation of setting the copy quantity are to be performed, and processing is in a waiting state until the operation of setting the copy quantity is performed in step 15. The copy paper size is calculated in step 16, based on the set original size and the magnification, and a copy paper feed cassette loading stage, wherein the copy papers of the above-mentioned calculated size are stored, is selected by the copy paper feed stage control circuit 83. Subsequently the above-mentioned decisions and processing in step 20 and thereafter are carried out.

(III) When neither of the automatic magnification setting mode and the automatic copy paper size setting mode is selected, and the display clear key 65 is turned ON, displays on the display part by the original size display 76, copy paper size display 77, the copy quantity display 69 and the size display 71 are cleared in step 17 by the display part control circuit 87, and display by the magnification display 73 is set to 100%. Thereafter in step 18 a message is displayed on the display 52 in dot-matrix form that the operation of setting the magnification, the operation of setting the copy paper size and the operation of setting the copy quantity are to be performed. Then processing is in a waiting state until the operation of setting the copy paper size and the operation of setting the copy quantity are performed in step 19. Subsequently the above-mentioned decisions and processings in step 20 and thereafter are carried out. Thus the setting operation to be performed differs depending upon each select mode, but by turning the display clear key 65 to ON, the display content in the display part is cleared, and corresponding to the cleared display content, the identification content of the setting operation to be performed is displayed in sequence on the display 52 in dot-matrix form. Therefore the problem of forgetting the initial setting operation to be performed before carrying out the copying operation is avoided, and so improper copies are not produced and copy papers, toner and the like are not wasted.

However, in the above case, it is possible that the display clear key 65 is omitted and the display on the display part is cleared automatically after a series of copying operations are completed or after warm-up is completed, and in this case, a forgotten initial setting operation caused by a forgotten operation of the display clear key 65 can be prevented adequately.

Also, in the above case, a size symbol in the size display 71 and the copy paper size display 77 displays the same size symbol, and therefore either of them can be omitted.

Also a step wherein decision is made on whether or not the print key 51 has been operated is inserted between steps 7 and 8, between steps 9 and 10, between steps 13 and 14, between steps 15 and 16 and between steps 19 and 20, and if the print key 51 has not been operated, decisions and processings in the following steps are performed, and if key 51 has been operated, decision is made on whether or not all the required setting operations have been performed. Then, when the required setting operation has been completed, decisions and processings in the following steps are performed like the above-mentioned case, but when the required setting operation is not completed wholly, it is possible that the setting operation not performed is decided, and the setting operation not performed is displayed on the display 52 in dot-matrix form, and processing is in a waiting state until the required setting operation is completed. In this case, the setting operation not performed can be displayed when it is wrongly taken thought that all the setting operations have been performed or the like, and thereby the operator can grasp immediately at a glance which operation has to be performed, and thus this is very convenient.

Also, a copying machine, if provided with an original feeding apparatus (not illustrated), can detect the original size when the original is fed by the original feeding apparatus, and therefore steps 6, 7, 12 and 13 in the above-mentioned flow chart can be omitted.

Also, the above-mentioned magnification setting is not always performed by operating the magnification setting key 60, but may be performed by selecting the set magnification memory through the access selecting key 62.

Next, description is made on FIG. 4 which shows operation of setting the magnification to be stored in the above-mentioned magnification memory 61.

First, in step 1, a decision is made on whether or not the memory set start key 63 is turned ON. Then, if OFF, a series of copying operations is performed in step 18.

On the other hand, if the memory set start key 63 is turned to ON, the magnification display 73 blinks in step 2. However, blinking in this case may be of the whole of the above-mentioned display part, or may be of a percent (%) part as part of the display part.

Next, in step 3, a lamp (not illustrated) built in the access selecting key 62 is lighted to display that the access selecting key 62 is to be operated, and in step 4 a message is displayed on the display 52 in dot-matrix form that the access selecting key 62 is to be operated, and in steps 5 and 6 processing is in waiting state until a predetermined time set in advance elapses or the access selecting key 62 is operated. Then, when the above-mentioned predetermined time elapses or the access selecting key 62 is operated within the predetermined time, the above-mentioned lamp is put out in step 7, and a lamp (not illustrate) built in the magnification setting key 60 is lighted in step 8 to display that the magnification setting key 60 is to be operated, and in step 9 a message is displayed on the display 52 in dot-matrix form that the magnification setting key 60 is to be operated. In step 10, processing is in waiting state until the magnification setting key 60 is operated. Then, when the magnification setting key 60 is operated, the lamp built in the magnification setting key 60 is put out in step 11, and a lamp (not illustrated) built in the memory setting end key 64 is lighted in step 12 to display that the memory setting key 64 is to be operated. In step 13 a message is displayed on the display 52 in dot-matrix form that the memory setting end key 64 is to be operated, and in step 14 processing is in waiting state until the memory setting end key 64 is operated. Then, when the memory setting end key 64 is operated, the lamp built in the memory setting end key 64 is put out in step 15, and blinking of the magnification display 73 is stopped and that display is lighted continuously, and thereby completion of memory the setting operation is displayed in step 16, and it is displayed also on the display 52 in dot-matrix form that the memory setting operation is completed in step 17. Thereafter a series of copying operations are carried out in step 18.

Note that the above-mentioned lamp may be replaced by any one capable of visual display, and a light emitting device such as LED or the like can be employed.

That is, in the case where the magnification setting operation is performed, lamps built in respective operation keys are lighted corresponding to the operation sequence, and identification of which operation key is to be operated is also displayed on the display 52 in dot-matrix form, and therefore even an unfamiliar operator can adequately perform operation of setting the magnification.

Next, description is made on FIG. 5 which shows a copying operation when the automatic exposure mode is selected or not.

In step 1, decision is made on whether or not the automatic exposure mode (automatic copy image density setting operation state) has been selected. Then, if the automatic exposure mode has been selected, display of the set copy image density data on the display part is cleared by the display part control circuit 87 in step 2, and operation of setting data by the copy image density setting key 59 on the operation panel 5 is inhibited by the data input inhibiting circuit 88 in step 3. In step 4 processing is in a waiting state until the print key 51 is turned ON. On the other hand, if decision is made that the automatic exposure mode has not been selected in step 1, the decision in step 4 is performed. Then, if the decision is made that the print key 51 has been turned to ON in step 4, the decision is made on whether or not the automatic exposure mode has been selected again in step 5.

When decision is made that the automatic exposure mode has been selected in step 5, automatic exposure operation is started in step 6, and processing is in waiting state until the automatic exposure operation is completed, that is, the exposure lamp 21 returns to the home position in step 7, and the above-mentioned cleared set copy image density data is displayed by the display part control circuit 87 in step 8, and a series of copying operations are performed based on the data displayed on the display part in step 9.

Also, when decision is made that the automatic exposure mode has not been selected in step 5, the processing in step 9 is performed intact.

That is, when the automatic exposure operation is carried out, display of the set copy image density data is cleared, and therefore the set copy image density data, in the case where copying operation is carried out, is not grasped at all, and also no new copy image density data can be entered, so that this state can be used as a display of the state of carrying out automatic exposure. Thereby such a disadvantage can be eliminated that the original cover is opened immediately after one cycle of exposure operation is carried out and thereby an improper copy is produced, and also no special display for displaying the state of automatic exposure operation is required to be mounted, and complication of the display part can be prevented.

In the above-mentioned embodiment, only display of the set copy image density data is cleared and also only a new copy image density setting operation is inhibited, but it is also possible that display of other set data is cleared and also setting operation of other data is inhibited. In this case, such a configuration has only to be adopted that there are inserted between step 8 and step 9 a step wherein the decision is made of whether or not new set data have been entered by operating various setting keys, a step wherein the decision is made of whether or not a predetermined time set in advance has elapsed with no new set data being entered, and a step wherein a new set data is displayed on the display part by the display part control circuit 87 when decision is made that a new set data has been entered are inserted between step 8 and step 9, and the decision on whether or not a new set data has been entered is repeated until the predetermined time elapses. In this case, all of displays are cleared and also all of operations of setting data are inhibited and therefore it can be seen more clearly that the automatic exposure mode has been selected.

In addition, the present invention is not limited to the above-mentioned embodiments, and, for example, the display 52 can be omitted, and the set magnification display 61, the access selecting key 62, the memory setting start key 63, which starts setting of the magnification to be stored in the set magnification display 61, and the memory setting end key 64, which ends setting of the magnification, can be omitted properly. The present invention can be applied to a copying machine provided with a document feeder. Furthermore various design changes can be made within a range wherein no important points of the invention are changed.

What is claimed is:

1. In a copying machine having an operating panel with a plurality of displays thereon, the displaying method comprising identifying certain data as set data, setting the copy image density by automatic exposure, clearing the set data at least during the setting of the copy image density, and displaying the set data after the setting of the copy image density is completed.

2. The displaying method in accordance with claim 1, wherein the period during which the display of set data is cleared is a period during which the setting operation of the copy image density by means of automatic exposure is completed after the automatic exposure function is selected.

3. The displaying method in accordance with claim 1, wherein the set data are all of the data which can be displayed.

4. The displaying method in accordance with claim 1, wherein the set data is only copy image density data which is set by the automatic exposure operation.

5. The displaying method in accordance with claim 1, further comprising setting at least some of the set data by operation of keys.

6. The displaying method in accordance with claim 5 further comprising inhibiting data setting by key operation during clearing of the display of data.

7. The displaying method in accordance with claim 6, wherein data which is exhibited is copy image density data.

* * * * *

UNITED STATES PATENT AND TRADEMARK OFFICE

CERTIFICATE OF CORRECTION

PATENT NO. : 4,708,470

DATED : November 24, 1987

INVENTOR(S) : Shinobu Satonaka, et al.

It is certified that error appears in the above—identified patent and that said Letters Patent is hereby corrected as shown below:

On the title page, left column, between "[22] Filed: Sep. 24, 1985" and "[51] Int. Cl. ..... G03G 15/00" insert -- [30] Foreign Application Priority Data Sep. 28, 1984 [JP] Japan 59-147757
Sep. 28, 1984 [JP] Japan 59-205229
Sep. 28, 1984 [JP] Japan 59-205231 --.

Signed and Sealed this

Seventeenth Day of May, 1988

*Attest:*

*Attesting Officer*

DONALD J. QUIGG

*Commissioner of Patents and Trademarks*